US006382103B1

(12) United States Patent
Rauh

(10) Patent No.: US 6,382,103 B1
(45) Date of Patent: May 7, 2002

(54) LATERAL REGISTRATION DEVICE HAVING INSERTION STRIPS AND REGISTER PINS

(75) Inventor: Volker Gerold Rauh, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,215

(22) PCT Filed: Dec. 22, 1998

(86) PCT No.: PCT/DE98/03759

§ 371 Date: Jun. 22, 2000

§ 102(e) Date: Jun. 22, 2000

(87) PCT Pub. No.: WO99/33664

PCT Pub. Date: Jul. 8, 1999

(30) Foreign Application Priority Data

Dec. 24, 1997 (DE) ..... 197 57 895

(51) Int. Cl.[7] ..... B41F 27/12

(52) U.S. Cl. ..... 101/415.1; 101/378; 101/DIG. 36; 101/383

(58) Field of Search ..... 101/415.1, 378, 101/383, 384, 385, 386, 387, 388, 486, DIG. 36

(56) References Cited

U.S. PATENT DOCUMENTS

| | | | | |
|---|---|---|---|---|
| 2,768,579 A | * | 10/1956 | Fies | 101/415.1 |
| 4,557,196 A | * | 12/1985 | Köbler | 101/415.1 |
| 4,748,911 A | * | 6/1988 | Kobler | 101/378 |
| 5,327,832 A | * | 7/1994 | Fscher | 101/415.1 |
| 5,379,694 A | * | 1/1995 | Haek et al. | 101/415.1 |

FOREIGN PATENT DOCUMENTS

| | | | |
|---|---|---|---|
| DE | 42 41 588 | * | 6/1994 |
| DE | 41 32 805 | * | 5/1995 |

* cited by examiner

*Primary Examiner*—Leslie Evanisko
(74) *Attorney, Agent, or Firm*—Jones, Tullar & Cooper, PC

(57) ABSTRACT

A lateral registration device for printing plates in a plate cylinder uses axially shiftable insertion strips. These insertion strips have register pins which engage recesses in the beveled ends of flexible printing plates inserted into an insertion slit. The insertion or guide strips are arranged adjacent each other in the circumferential direction of the plate cylinder.

3 Claims, 2 Drawing Sheets

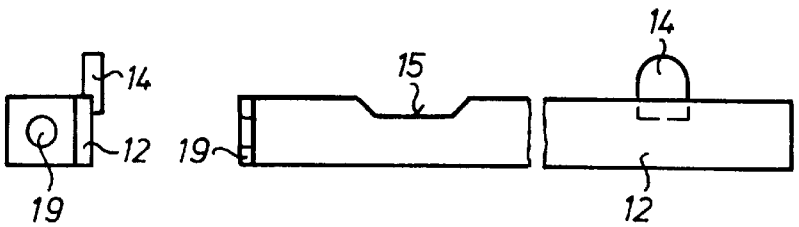
Fig.3
Fig.4
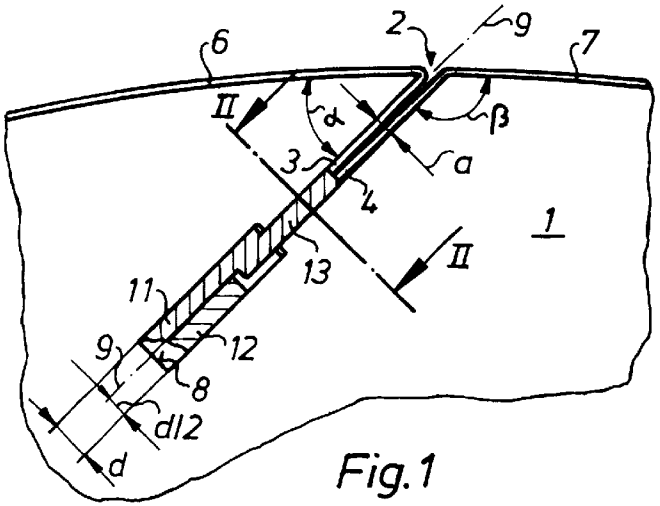
Fig.1
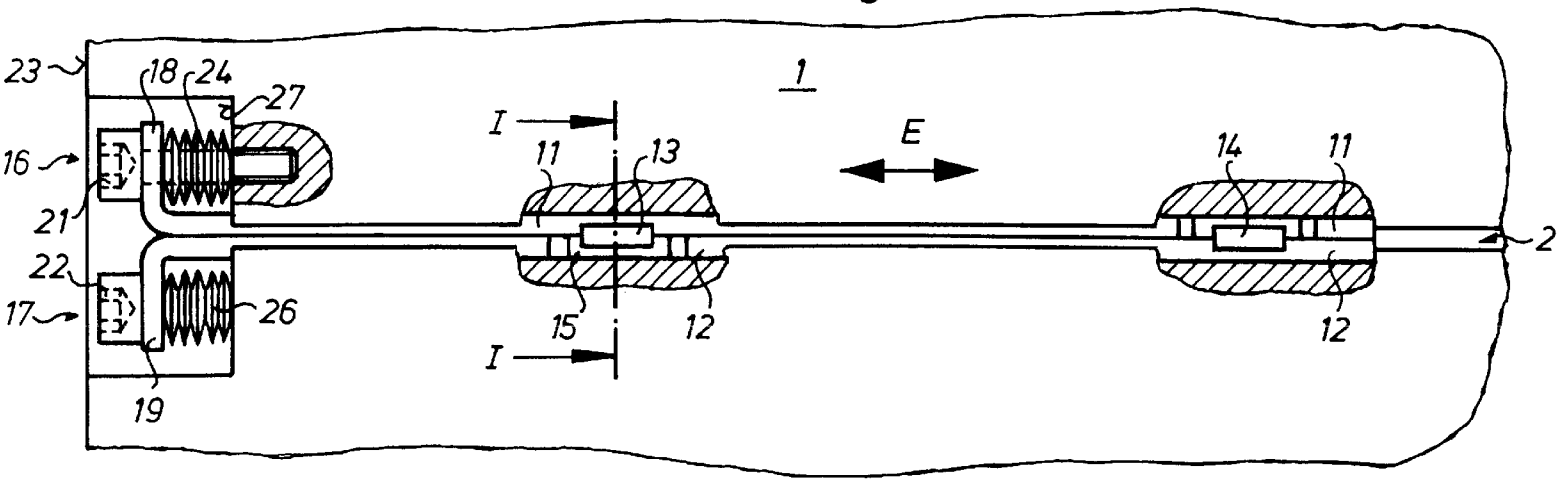
Fig.2

LATERAL REGISTRATION DEVICE HAVING INSERTION STRIPS AND REGISTER PINS

FIELD OF THE INVENTION

The present invention relates to an adjustment device for a lateral register of at least two adjacent flexible printing plates. Axially adjustable strips that accomplish the lateral registration are spaced circumferentially.

DESCRIPTION OF THE PRIOR ART

A lateral register adjustment device for printing plates is known from DE 42 41 588 C2. Printing plates have beveled edges which are fastened in a slit or in several slits extending in an axis-parallel direction along the circumference of the printing cylinder. Each one of the printing plates has a recess for this, which recess is engaged by a respective register pin which, in turn, is fixedly connected with one insertion strip, respectively. This insertion strip is movable in an axis-parallel direction in the slit. The insertion strips are arranged on top of each other in the slit and are each connected with a separate adjustment system.

SUMMARY OF THE INVENTION

The object of the present invention is based on providing an adjustment device for a lateral register.

In accordance with the present invention, this object is attained by the provision of printing plates whose beveled ends are received in a slit or channel in the printing cylinder. Each plate end has a register recess that will receive a register pin which is carried by an axially displaceable insertion strip. The insertion strips are situated one behind the other in the circumferential direction of the printing cylinder.

The advantages which can be achieved by means of the present invention rest, in particular, in that a lateral register adjustment device for printing plates with beveled edges has been created (slit clamping), whose insertion strips are secured against being ejected from the slit by simple means. Furthermore, the slit can be kept narrow, even if solid insertion strips are used. The beginning or leading end of each printing plate is provided with a lateral register adjustment device.

BRIEF DESCRIPTION OF THE DRAWINGS

Two preferred embodiments of the present invention are represented in the drawings and will be described in greater detail in what follows.

Shown are in:

FIG. 1, a cross section through a schematically represented lateral register adjustment device taken along line I—I in FIG. 2 of a first preferred embodiment, FIG. 2, a section taken along line II—II of FIG. 1 of the lateral register adjustment device with an unrestricted view of the insertion strips, FIG. 3, a side view of an insertion strip.

FIG. 4, an end view of the insertion strip in FIG. 3, and in

DESCRIPTION OF THE PREFERRED EMBODIMENTS

Figure 5:
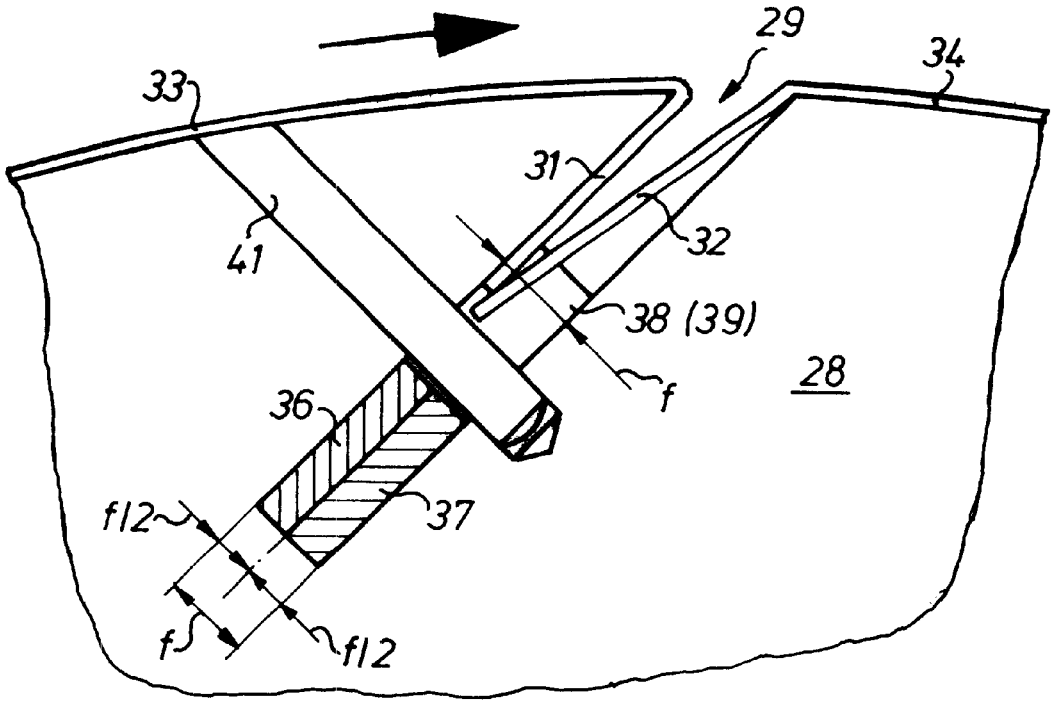
FIG. 5, a cross section through a schematically represented lateral register adjustment device in accordance with a second preferred embodiment.

A printing cylinder 1 has, on its circumference, secant-like narrow plate end insertion slits 2 of a width a, and extending in an axis-parallel direction, for receiving the beveled ends 3, 4 of flexible first and second printing plates 6, 7. Here, the leading end 3 of the first printing plate 6 extends at an angle $\alpha$ of approximately 35° in relation to the printing plate 6, and the trailing end 4 of the second printing plate 7 extends at an angle $\beta$ of approximately 145° in relation to the printing plate 7. Both ends 3, 4 are together fastened in the slit 2, all as seen in FIG. 1.

An insertion strip channel 8 having a rectangular cross section and a channel width d which is greater than the width a of the slit 2, for example, extends underneath each slit 2. The insertion strip channel 8 extends parallel with the slit 2 and is symmetrical in respect to a plane 9, which is also the vertical axis of the slit 2. The insertion strip channel 8 is connected with the slit 2.

Two insertion strips 11, 12 are arranged next to each other and are each movable back and forth in the axial movement direction E, shown in FIG. 2, of the printing cylinder 1 in the insertion strip channel 8. The channel 8 can be created by spark erosion, for example.

Each one of the insertion strips 11, 12 supports at least one register pin 13, 14, as seen in FIGS. 1–4, which register pin 13 or 14 is guided in the plate end insertion slit 2 and is fixedly connected with the respective insertion strip 11, 12 or is made of one piece with it. The register pin 13, 14 has a maximum thickness which corresponds to the width a of the slit 2, while each insertion strip 11, 12 has a maximum thickness which corresponds to half the width d of the insertion strip channel 8. Here, the width d/2 can be greater than the width a. The insertion strip 12 supporting the register pin 14 which is situated remote from the end face 23 of cylinder 1, has a recess 15 on its top surface; i.e. the surface facing the ends 3, 4. The length of recess 15, as seen in FIG. 3, is greater than the clear dimension of the register pin 13 of the insertion strip 11. This recess 15 is provided to allow for the unrestricted movement of the register pin 13.

Each register pin 13, 14 engages a recess of a beveled end of a printing plate in an interlocking manner which is not specifically shown in the drawings.

On its end, each insertion strip 11, 12 is provided with an adjustment device 16, 17 for accomplishing its axial back-and-forth movement E. This adjustment device 16, 17 can, for example, be structured in such a way that each insertion strip 11, 12 is angled in an L-shape on one of its ends, wherein the angle piece 18, 19 is fastened on the end face 23 of the printing cylinder 1 by means of a screw 21, 22, all as shown in FIG. 2.

A variable number of intermediate pieces 24, 26, for example spring elements, are located between the angle piece 18, 19 and the end face 23 of the printing cylinder 1.

The adjustment devices 16, 17 are preferably located in a partially routed-out notch 27 in the cylinder end face 23. The printing plate 6 can be moved back and forth in the axial movement direction E by varying the number of intermediate pieces 24, 26. However, once a basic adjustment has been performed, a simple turning of the screw 21, 22 is sufficient to accomplish a fine lateral register adjustment. It is, of course, also possible to fasten a block at the end of the insertion strip 11, 12 instead of the angle piece 18, 19, and to provide it with an axial bore for receiving the screw 21, 22.

If four printing plates are arranged next to each other on the printing cylinder 1, it is possible to also arrange laterally reversed adjustment devices on a second, opposite end face of the printing cylinder 1 , and to arrange separate insertion strips in the second cylinder half.

In accordance with a second preferred embodiment, as seen in FIG. 5, a printing cylinder 28 has a secant-like plate end insertion slit 29 of a width f, in which beveled ends 31, 32 of flexible printing plates 33, 34 are maintained. Insertion strips 36, 37 of a maximum thickness of half the width f of the slit 29 are arranged next to each other in the lower portion of the slit 29.

Each insertion strip 36, 37 is fixedly connected with a register pin 38, 39, which engages a recess in a printing plate in an interlocking manner which is not specifically shown in FIG. 5. Each register pin 38, 39 can maximally have the thickness f of the slit 29.

To secure the insertion strips 36, 37 against the effects of centrifugal force when cylinder 28 is in the operating state, the insertion strips 36, 37 are held on their sides facing the beveled plate ends 31, 32 by means of pins 41 fixed on the cylinder and extending into the plate end insertion slit 29.

While preferred embodiments of a lateral registration device in accordance with the present invention have been set forth fully and completely hereinabove, it will be apparent to one of skill in the art that changes in, for example the overall size of the cylinders, the type of flexible plates secured to its surface and the like could be made without departing from the true spirit and scope of the present invention which is accordingly to be limited only by the following claims.

What is claimed is:

1. An adjustment device adapted to accomplish lateral registration of at least first and second flexible printing plates having ends, said adjustment device comprising:

a printing cylinder having a peripheral surface extending in a circumferential direction of said printing cylinder, and a printing plate end insertion slit extending in an axial direction of said printing cylinder, the at least first and second printing plates adapted to be positioned at the same position in said circumferential direction and spaced from each other in said axial direction on said peripheral surface of said printing cylinder with the printing plate ends of the at least first and second printing plates both in said printing plate end insertion slit;

at least first and second insertion strips positioned in said printing plate end insertion slit, said at least first and second insertion strips each having a length and width, with side faces extending along said length, said at least first and second insertion strips being located one behind the other in said circumferential direction of said printing cylinder and abutting each other along said side faces, each of said at least first and second insertion strips being independently shiftable in said axial direction in said printing plate end insertion slit to accomplish lateral registration of the corresponding one the first and second printing plates; and a register pin on each one of said at least first and second insertion strips, each said register pin being receivable in a cooperating register recess in each one of the printing plate ends.

2. The adjustment device of claim 1 further including an insertion strip channel in said printing cylinder beneath, in a radial direction, said insertion slit, said insertion strip channel being wider than said insertion slit, said insertion strips being positioned in said insertion strip channel.

3. The adjustment device of claim 1 further including pins secured in said cylinder, said pins preventing radial outward movement of said insertion strips in said plate end insertion slit upon rotation of said printing cylinder.

* * * * *